US005203612A

United States Patent [19]

Pokrzywinski

[11] Patent Number: 5,203,612

[45] Date of Patent: Apr. 20, 1993

[54] CHILD SEATING RESTRAINT SYSTEM

[76] Inventor: Annette L. Pokrzywinski, 4020 N. 135th St., Brookfield, Wis. 53005

[21] Appl. No.: 887,214

[22] Filed: May 21, 1992

[51] Int. Cl.[5] ..... A47D 1/10

[52] U.S. Cl. ..... 297/466; 297/250; 297/485; 297/487

[58] Field of Search ..... 297/250, 466, 467, 485, 297/487, 488, 383, 464; 108/43

[56] References Cited

U.S. PATENT DOCUMENTS

| | | | |
|---|---|---|---|
| 1,025,953 | 5/1912 | Hallen | 297/487 |
| 1,259,604 | 3/1918 | Cook . | |
| 1,902,367 | 3/1933 | Johnson | 297/467 |
| 2,084,448 | 3/1936 | Merchant . | |
| 2,532,812 | 12/1950 | Huber | 297/149 |
| 2,552,720 | 5/1951 | Keough | 297/151 |
| 4,819,988 | 4/1989 | Hellstrom . | |
| 5,081,936 | 1/1992 | Drieling | 108/43 |

FOREIGN PATENT DOCUMENTS

| | | | |
|---|---|---|---|
| 2360447 | 4/1978 | France | 297/467 |

*Primary Examiner*—Peter R. Crown
*Attorney, Agent, or Firm*—Quarles & Brady

[57] ABSTRACT

A system for preventing a child from voluntarily or accidentally leaving the chair in which he or she is seated. The system provides a partial enclosure of the child's upper legs and lower torso, the enclosure being contoured to the general shape of these parts of a seated child. Also provided are a tenon sliding in a mortise and a pawl which engages ratchet teeth to permit adjusting the system for the size of the child and for locking the components of the system together during use.

4 Claims, 3 Drawing Sheets

CHILD SEATING RESTRAINT SYSTEM

BACKGROUND

1. Field of the Invention

The present invention relates generally to the art of seating, more particularly to the field of safety seat systems intended to hold a person, especially a toddler or infant, in a chair in such fashion as to reduce or eliminate the possibility of the person from voluntarily or involuntarily leaving the chair.

2. Description of the Art

Infants and very young children should be provided with some type of restraining device when seated in a high chair or other type of chair in order to protect them from injury if they should accidentally fall from the chair. Young children, such as active toddlers, should be provided with similar protection as it is remarkably easy for an inventive, active child to voluntarily work out of a high chair and sustain injury.

Various devices have been proposed in prior patents as a means for retaining a child in a chair. Patents known to me at the filing date hereof that describe this type of device consist of the following U.S. patents:

U.S. Pat. No. 1,259,604, Cook, issued 1918;

U.S. Pat. No. 1,902,367, Johnson, issued 1933;

U.S. Pat. No. 2,084,448, Merchant, issued 1937; and

U.S. Pat. No. 4,819,988, Hellstrom, issued 1989.

My market survey of seat restraining devices currently being sold indicate that none of the devices proposed by the above patents is employed commercially at the present time.

The conventional child restraint system employed with high chairs now on the market consists of a belt that extends about the child's waist and a strap that extends between the child's legs. This type of safety belt system, however, is inadequate because there is simply too much slack in the belt system and not enough support for the child no matter how tightly the belt is adjusted. This results in the child being able to slide forward and/or slouch to one side, so that the belt system is not an effective control. Some prior art devices, such as that of U.S. Pat. No. 4,819,988, help to preclude a child from sliding forward by incorporating a rigid pelvic abductor between the child's legs. The abductor prevents the child from sliding the pelvis forward, but an occupant can still shift his/her hips to one side, thereby resulting in slouching.

Conventional child seat restraining systems, and those of the above patents, have failed to account for the flexibility and inventiveness displayed by young children which enable them to escape from seat restraining systems more easily than is generally recognized. The prior seat restraining devices do not provide optimum protection for a child. There is, as a result, an unfulfilled need for an enhanced child seating restraint system, and the stimulus for my present invention was to satisfy this need by developing a new child seating restraint system that is capable of restraining a child in a more effective and safe manner than prior art devices.

Another principal objective of my present invention is to provide a new child safety seating system that includes a structural member configured so as to preclude a child from sliding forwardly to an unacceptable or unsafe degree. A further principal objective is to provide a system that fits easily onto current standard high chairs without any of the special adaptations required by prior art devices.

A further and important principal objective of my present invention was to develop a child safety seating system that is capable of providing posture support for the child who is just beginning to use a high chair. Such a child, perhaps five or six months old, often cannot hold themselves upright for an entire feeding. Parents often resort to pillows or towels to prop up such a child. The present invention is designed to provide the necessary posture support for such a child. None of the prior art devices are capable of attaining this objective.

Young children find it relatively easy to lift one or both of their legs and gain enough of a foothold on the seat of a chair to raise themselves to a standing position. This is an obvious dangerous situation since the child is quite likely to fall from the chair. Another important and principal objective of my present invention is to provide a restraint system for a child seated on a chair that reduces or eliminates the possibility of the child standing up on the chair, so as to thereby offer additional protection for the child while seated.

The manner in which the present invention satisfies the above objectives, as well as other principal and more specific objectives, will become apparent in the full and complete enabling presented below.

SUMMARY OF THE INVENTION

In summary, the new child seat restraining system which I now disclose a base member and a top member that is of a pants-like configuration having a portion surrounding the upper thighs of an occupant and a portion surrounding part of the torso or waist area of an occupant. In the exemplary embodiment, the top member is in the shape of the front of a pair of pants comprising leg portions and an abdominal portion as integral elements of a top member. The exemplary embodiment also provides a top member that is movable relative to the base member so as to be adjustable to accommodate children of various sizes, and further includes locking means to hold the top member in a selected position relative to the base member.

DESCRIPTION OF PREFERRED EMBODIMENT

Figure 2:
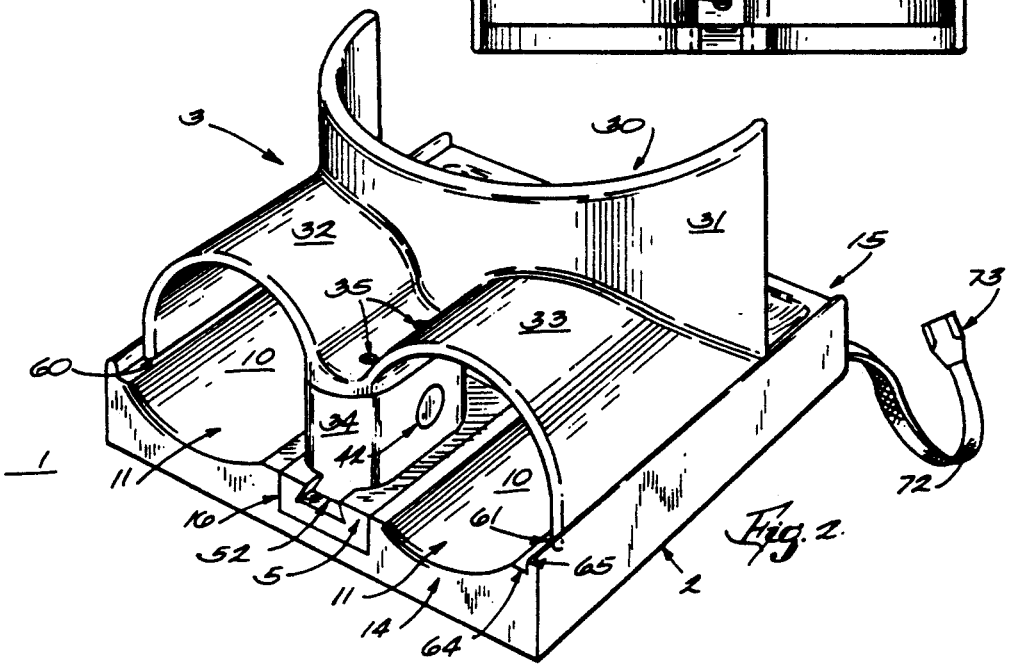
FIG. 2 is a perspective view of a preferred embodiment.

FIG. 2 shows the three principal elements of a seating restraint system 1 according to the present invention: a base member 2, a top member 3 and an adjusting and locking assembly made up of pawl assembly 4 and ratchet path 5.

The base member 2 is shown as a three-dimensional element whose upper surface 10 includes forward portions 11 and rear portion 12. In a preferred embodiment, forward portions 11 are curved in cross section to provide comfortable support for the upper legs of the seated child, and rear portion 12 is shaped for the comfortable support of the child's buttocks. A slot 13 in the base member 2 extends from front end 14 of the base member 2 partway towards its back wall 15. Slot 13 is located along the centerline of the base member 2 and is defined by a walls 16. Ratchet path 5 is mounted in slot 13 by screws 17. Alternatively, ratchet path 5 could be an integral part of base member 10.

Top member 3 is a three dimensional structure in the shape of a portion of a pair of pants. As shown in FIG. 2, top member 3 is formed to include both a curved waist portion 30 having a vertical panel 31 and a pair of upper leg portions 32 and 33 extending horizontally from the waist portion. Waist portion 30 is curved so as to fit about the waist and lower abdominal area of the torso of a child. Similarly, leg portions 32 and 33 are curved so as to fit about the upper thigh portions of the right and left legs, respectively, of the occupant. The housing 34 of pawl assembly 4 is attached by screws 35 to the top member 3 at the intersection of upper leg portions 32 and 33. Housing 34 also serves as a pommel which prevents the occupant from sliding forward between base member 2 and top member 3.

The adjusting and locking assembly consists of pawl assembly 4 and ratchet path 5.

Figure 4:
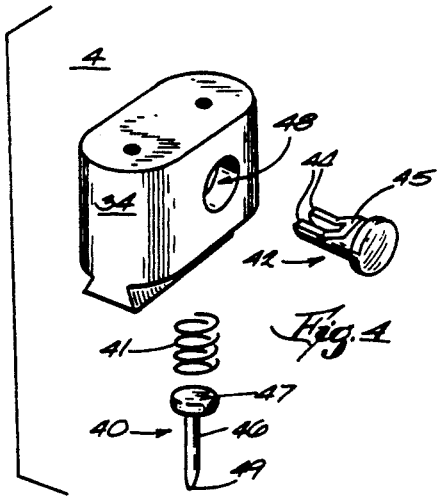
FIG. 4 is an exploded perspective view of the top part of the adjusting and locking assembly of a preferred embodiment.
Figure 3:
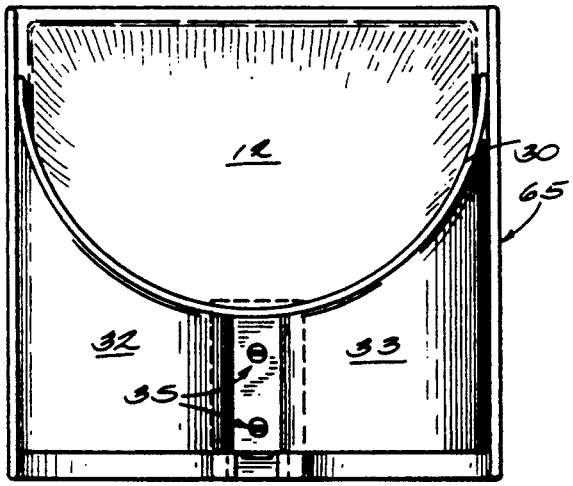
FIG. 3 is a top plan view of a preferred embodiment.
Figure 6:
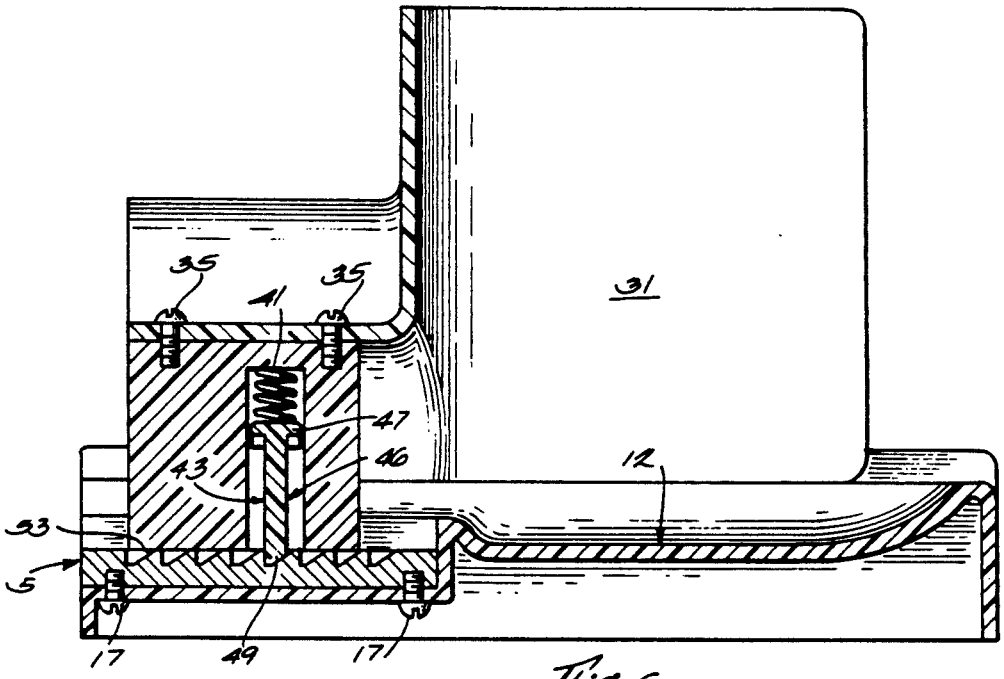
FIG. 6 is a side sectional view along the plane of line 6—6 of FIG. 5.
Figure 5:
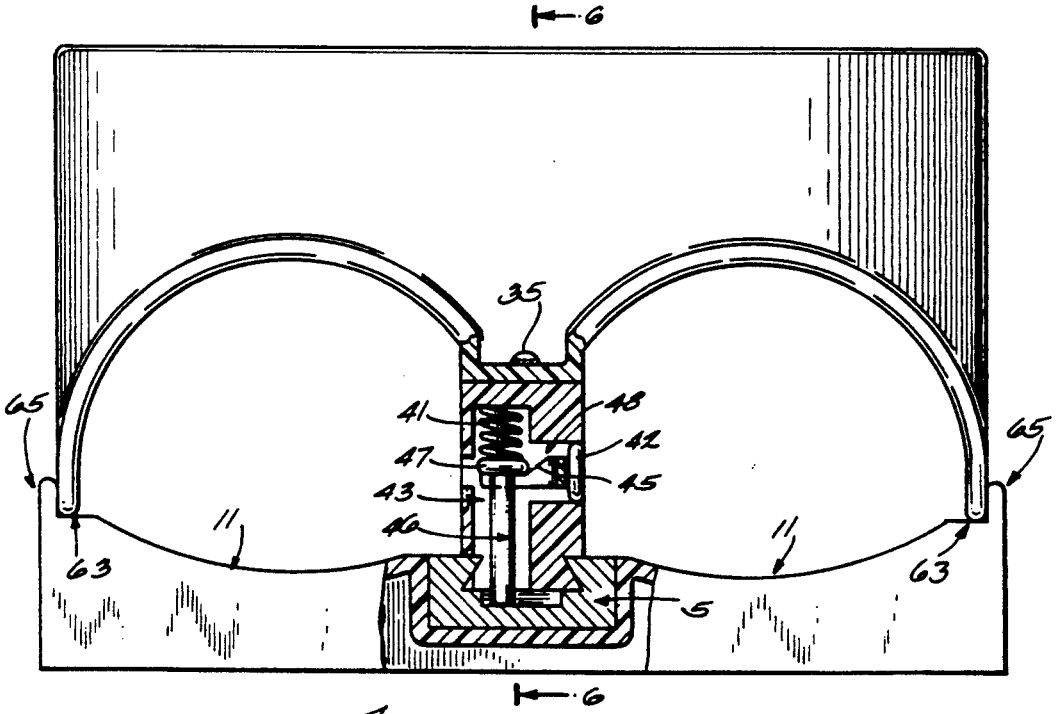
FIG. 5 is a front view of a preferred embodiment, showing the locking and adjusting assembly in cross section.
Figure 7:
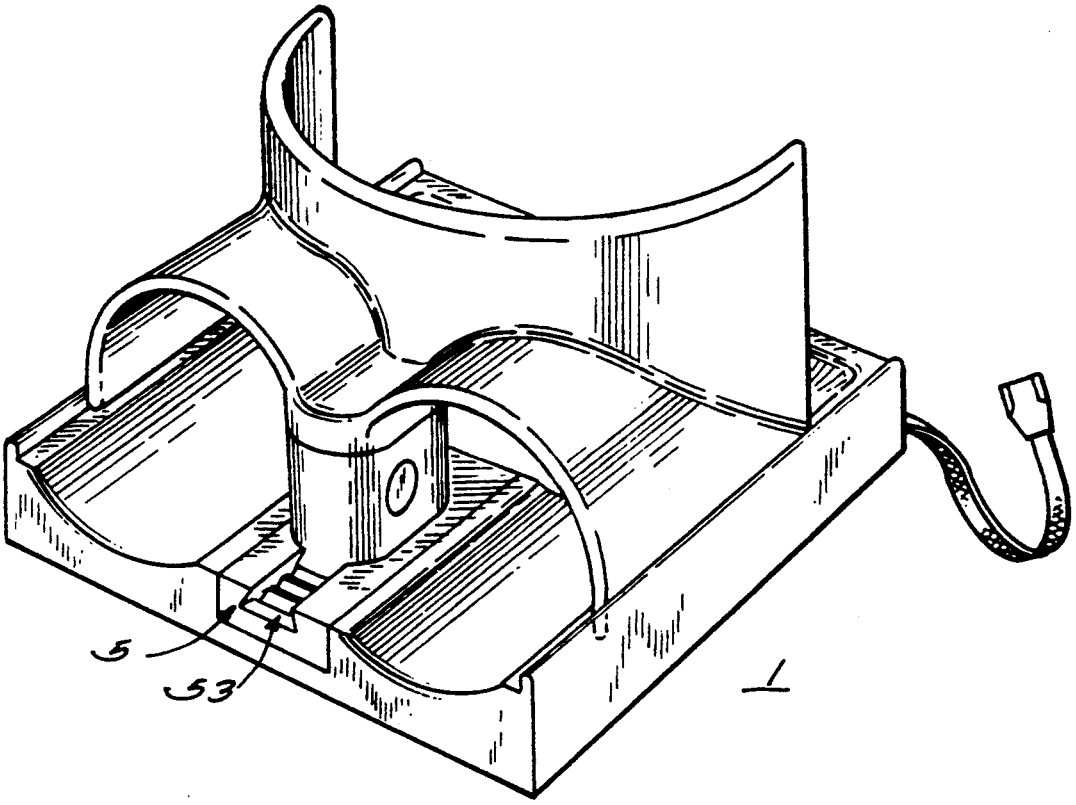
FIG. 7 is a perspective view of a second preferred embodiment.

As shown in FIG. 4, pawl assembly 4 consists of housing 34, pawl 40, spring 41 and cam button 42. As shown in FIGS. 5 and 6, housing 34 has an internal vertical bore 43. Spring 41 is inserted upward into bore 43, to be followed head first by pawl 40. Cam button 42 has arms 44 and an inclined cam surface 45. Cam button 42 is inserted into a horizontal bore 48 of housing 34 so that its arms 44 embrace the shaft 46 of pawl 40 and so that head 47 of pawl 40 rests upon arms 44. Arms 44 may have knobs at their ends to prevent accidental removal of cam button 42 from its embrace of shaft 46 of pawl 40. Bores 43 and 48 and pawl 40 are disposed and sized so that tip 49 of pawl 40 extends below the bottom surface 50 of housing 34. The bottom surfaces 50 of housing 34 form a tenon in the shape of a dovetail.

The top of ratchet path 5 has a mortise groove 52 in the shape of a dovetail. It is sized and shaped so that tenon 50 of housing 34 can be slid into mortise 52 from the front and so that housing 34 cannot be vertically disengaged from ratchet path 5. The floor of mortise groove 50 has of a series of inclined plane ratchet teeth 53 which are sized to mesh with tip 49 of pawl 40.

The tenon of housing 34 and mortise groove 52 need not be in the shape of a dovetail. Other shapes which would prevent housing 34 from being vertically disengaged from ratchet path 5 would work.

The assembled system 1 is shown in FIG. 2 wherein top member 3 is illustrated combined with base member 2. Outboard edges 60 and 61 of leg portions 32 and 33 of the top member 3 rest along ledges 63 and 64 of forward portion 11 of the base member 2. As indicated in FIG. 2, ledges 63 and 64 are most usefully formed to include an outer lip or flange 65; the flanges 65 each bear against the outer surface of the adjacent leg portion 32 or 33 so as to restrain the top member 3 from moving laterally relative to the base member 2. The front view of FIG. 5 also shows this relationship.

Figure 1:
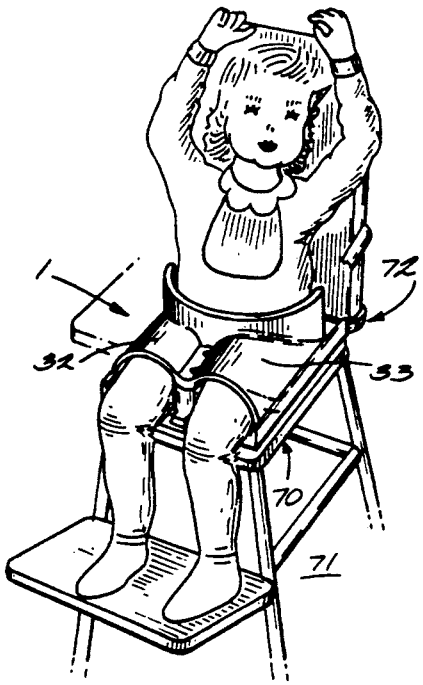
FIG. 1 is a perspective view of a child in a preferred embodiment of the invention, which is mounted on the seat of a high chair.

FIG. 1 illustrates the manner in which seating assembly 1 can be secured to the seat 70 of a high chair 71. Base member 2 of the assembly rests on seat 70. The ends of an adjustable strap 72 are attached to back end 15 of base member 2. Strap 72 can include a buckle 73 (of the type shown or of other types) or other suitable devices such as strips of Velcro ® tape so that the strap can be tightened in place around the back of the high chair 71. Additional straps, and other securing methods, may also be employed in view of strap 72.

To use the system, a child is seated upon base member 2. Top member 3 is then attached to base member 2 by sliding tenon 51 into mortise groove 52. As top member 3 is pushed toward the child, tip 49 of pawl 40 travels up an inclined plane of ratchet path 5 until it reaches the peak and then, under the urging of spring 41, drops into the valley; this action continues as long as top member 3 is moved backward toward the seated child. However, the engagement of tip 49 with the teeth of ratchet path 5 prevents top member 3 from being pushed forward, away from the child, unless cam button 42 is pushed. Pushing cam button 42 causes cam surface 45 to raise head 47 of pawl 40, thereby disengaging tip 49 from the teeth of ratchet path 5. Thus, the top member 3 can be removed only while cam button 42 is held depressed into housing 34. In this way, top member 3 can be easily adjusted to fit the size of the child, but cannot be removed by the child's lifting or pushing on it.

The system may be made of any suitable material, including injection molded plastic.

Although the preferred embodiments of the invention have been described above, the invention claimed is not so restricted. There may be various other modifications and changes to this embodiment which are within the scope of the invention. Thus, the invention is not to be limited by the specific description above, but should be judged by the claims which follow.

I claim:

1. A system for restraining a seated child, comprising:
   (a) a base member having two elongated curved depressions each being suitable for partially surrounding at least a segment of an horizontally forward extending thigh of a child seated on the base member;
   (b) a top member suitable for placement atop the base member and having:
      (1) a substantially vertical wall disposed to restrain and support the waist and abdomen area of the seated child; and
      (2) two parallel elongated curved vaults extending forward from the wall and disposed, when the top member is properly atop the base member, to align with the curved depressions of the base member in order to form two passageways each of which completely surrounds at least a segment of a thigh of the seated child;
   (c) whereby when the top member is properly atop the bottom member they form a pants-like enclosure for the thighs of the seated child and a support for the waist and lower abdomen of the seated child.

2. A system for restraining a seated child according to claim 1, further comprising:
   (d) a narrow-mouthed mortise in the base member, with a floor having a path of ratchet teeth;
   (e) a widening tenon extending downward from the top member sized to move slidably along the axis of the mortise and to be incapable of moving vertically out of the mortise;

(f) a pawl associated with the tenon and slidably extending downward beyond it to engage the ratchet teeth.

3. A system for restraining a seated child, comprising:

(a) a base member sized to support the buttocks and legs of the child;

(b) a top member having an inner surface comprising a waist portion contoured to the general shape of the front of the waist and abdomen area of a seated child, two upper leg portions contoured to the general shape of the tops of the upper legs of a seated child and a pommel extending down between the upper leg portions, the top member resting atop the base member and thereby forming with it a partial enclosure for the front lower torso, groin and upper legs of the child;

(c) an assembly for adjusting the proximity of the waist portion to the child and for locking the top member to the base member during use, comprising a narrow-mouthed mortise in the base member, with a floor having a path of ratchet teeth, a widening tenon extending downward from the top member sized to move slidably along the axis of the mortise and to be incapable of moving vertically out of the mortise, a pawl associated with the tenon and slidably extending downward beyond it to engage the ratchet teeth, a spring to urge the pawl toward the ratcheted teeth, and a push-button shaft with an inclined surface to slidably raise the pawl and thereby disengage it from the ratchet teeth.

4. A system for restraining a seated child, comprising:

(a) a base member sized to support the buttocks and legs of the child and having an upper surface contoured to the general shape of the buttocks and the bottoms of the upper legs of a seated child;

(b) a top member having an inner surface comprising a waist portion contoured to the general shape of the front of the waist and abdomen area of a seated child, two upper leg portions contoured to the general shapes of the tops of the upper legs of a seated child and a pommel extending down between the upper leg portions, the top member resting atop the base member and thereby forming with it a partial enclosure for the front lower torso, groin and upper legs of the child;

(c) an assembly for adjusting the proximity of the waist portion to the child and for locking the top member to the base member during use comprising a narrow-mouthed mortise in the base member, with a floor having a path of ratchet teeth, a widening tenon extending downward from the top member sized to move slidable along the axis of the mortise and to be incapable of moving vertically out of the mortise, a pawl associated with the tenon and slidably extending downward beyond it to engage the ratcheted teeth, a spring to urge the pawl toward the ratcheted teeth, and a push-button shaft with an inclined surface to slidable raise the pawl and thereby disengage it from the ratchet teeth.

* * * * *

UNITED STATES PATENT AND TRADEMARK OFFICE

CERTIFICATE OF CORRECTION

PATENT NO. : 5,203,612

DATED : April 20, 1993

INVENTOR(S) : Annette L. Pokrzywinski

It is certified that error appears in the above-identified patent and that said Letters Patent is hereby corrected as shown below:

In column 4, line 59 "bottom" should be --base--.

Signed and Sealed this

Thirtieth Day of November, 1993

*Attest:*

*Attesting Officer*

BRUCE LEHMAN

*Commissioner of Patents and Trademarks*